US008453395B2

(12) United States Patent
Couture

(10) Patent No.: US 8,453,395 B2
(45) Date of Patent: Jun. 4, 2013

(54) MODULAR STAIRWAY SYSTEM AND KIT THEREFOR

(76) Inventors: Raymond Couture, Quebec (CA); Armande Couture, legal representative, Quebec (CA)

( * ) Notice: Subject to any disclaimer, the term of this patent is extended or adjusted under 35 U.S.C. 154(b) by 0 days.

(21) Appl. No.: 12/703,494

(22) Filed: Feb. 10, 2010

(65) Prior Publication Data

US 2010/0287854 A1 Nov. 18, 2010

Related U.S. Application Data

(63) Continuation of application No. PCT/CA2008/001438, filed on Aug. 11, 2008.

(60) Provisional application No. 60/935,418, filed on Aug. 10, 2007, provisional application No. 61/064,575, filed on Mar. 13, 2008.

(51) Int. Cl.
*E04F 11/00* (2006.01)
*E04F 19/10* (2006.01)

(52) U.S. Cl.
USPC ..... 52/188; 52/741.2; 52/191; 52/182; D25/69

(58) Field of Classification Search
USPC ..... 52/182, 188, 190, 191, 741.2; D25/69
See application file for complete search history.

(56) References Cited

U.S. PATENT DOCUMENTS

| | | | | | |
|---|---|---|---|---|---|
| 569,464 | A | * | 10/1896 | Moore | 52/188 |
| 1,063,216 | A | * | 6/1913 | Nesdall | 52/188 |
| 2,593,683 | A | | 4/1952 | Lyons | |
| 3,470,664 | A | | 10/1969 | Whitehead | |
| 3,909,997 | A | | 10/1975 | Eickhof | |
| 4,422,270 | A | | 12/1983 | Lapointe | |
| 4,464,870 | A | | 8/1984 | Crepeau | |
| 4,635,416 | A | * | 1/1987 | Ayala | 52/188 |
| 4,866,894 | A | * | 9/1989 | Brown | 52/182 |
| 4,951,434 | A | | 8/1990 | Schmidt | |
| 5,347,774 | A | * | 9/1994 | Smith | 52/182 |
| 5,636,483 | A | * | 6/1997 | Wille | 52/188 |
| 5,899,032 | A | * | 5/1999 | Buzby | 52/182 |
| 6,088,977 | A | * | 7/2000 | Lawrence | 52/182 |

(Continued)

FOREIGN PATENT DOCUMENTS

| | | |
|---|---|---|
| CA | 2149981 | 5/1995 |
| CA | 2276988 | 12/1999 |
| FR | 2628134 | 9/1989 |
| JP | 6108602 | 4/1994 |
| WO | WO 2005/090705 | 9/2005 |

*Primary Examiner* — Joshua J Michener
*Assistant Examiner* — Chi Q Nguyen
(74) *Attorney, Agent, or Firm* — Verrill Dana, LLP; Chris A. Caseiro

(57) ABSTRACT

A stairway system, kit and method for assembling the kit are provided, the system including pre-fabricated components such as steps, stringers, decorative moldings and panels or boards, etc., on site. The kit comprises a step module and an adjacent step module, the step module comprising a riser and a tread, the riser being adapted to abut the tread on a first side thereof and being adapted to define a fastener-mating portion on a second side thereof. The tread is adapted to be secured atop the riser on one side thereof. The adjacent step module comprises a riser and a tread, the adjacent step module being adapted to be assembled with the step module by engaging a fastener with the fastener-mating portion of the step module and securing the fastener to the tread of the adjacent step module to secure the two step modules together.

40 Claims, 16 Drawing Sheets

U.S. PATENT DOCUMENTS 6,112,480 A * 9/2000 Turner ..... 52/182
6,125,598 A * 10/2000 Lanphier ..... 52/182
6,230,454 B1 5/2001 Meagher
6,397,529 B1 * 6/2002 Grenier ..... 52/182

* cited by examiner

| Inches Fraction Total height | Shortest rise | | | | | Fewest Steps | | | | |
|---|---|---|---|---|---|---|---|---|---|---|
| | # of risers | Rise | Total Run | Hypotenuse | # of step modules | # of risers | Rise | Total Run | Hypotenuse | # of step modules |
| 98 7/16 | 14 | 7 1/16 | 123 8/16 | 157 15/16 | 13 | 13 | 7 9/16 | 114 | 150 10/16 | 12 |

Formulas above seem to box in the minimum run to 7 inches and maximum to 8 inches.
Tuning is rounded to 1/16 of an inch. Is this detailed enough ? 13 steps x 1/32 error adds up to 7/16 inch
heres a sample table

| | | | | | | | | | | |
|---|---|---|---|---|---|---|---|---|---|---|
| 105 8/16 | 15 | 7 1/16 | 133 | 169 12/16 | 14 | 14 | 7 9/16 | 123 8/16 | 162 7/16 | 13 |
| 105 | 14 | 7 8/16 | 123 8/16 | 162 2/16 | 13 | 14 | 7 8/16 | 123 8/16 | 162 2/16 | 13 |
| 104 8/16 | 14 | 7 7/16 | 123 8/16 | 161 12/16 | 13 | 14 | 7 7/16 | 123 8/16 | 161 12/16 | 13 |
| 104 | 14 | 7 7/16 | 123 8/16 | 161 7/16 | 13 | 13 | 8 | 114 | 154 5/16 | 12 |
| 103 8/16 | 14 | 7 6/16 | 123 8/16 | 161 2/16 | 13 | 13 | 7 15/16 | 114 | 154 | 12 |
| 103 | 14 | 7 6/16 | 123 8/16 | 160 13/16 | 13 | 13 | 7 15/16 | 114 | 153 10/16 | 12 |
| 102 8/16 | 14 | 7 5/16 | 123 8/16 | 160 8/16 | 13 | 13 | 7 14/16 | 114 | 153 5/16 | 12 |
| 102 | 14 | 7 5/16 | 123 8/16 | 160 3/16 | 13 | 13 | 7 14/16 | 114 | 153 | 12 |
| 101 8/16 | 14 | 7 4/16 | 123 8/16 | 159 14/16 | 13 | 13 | 7 13/16 | 114 | 152 10/16 | 12 |
| 101 | 14 | 7 3/16 | 123 8/16 | 159 9/16 | 13 | 13 | 7 12/16 | 114 | 152 5/16 | 12 |

FIG. 21

| Inches Fraction Total height | # of risers | Rise | Total Run | Hypotenuse | # of step modules | # of risers | Rise | Total Run | Hypotenuse | # of step modules |
|---|---|---|---|---|---|---|---|---|---|---|
| 98 7/16 | 14 | 7 1/16 | 123 8/16 | 157 15/16 | 13 | 13 | 7 9/16 | 114 | 150 10/16 | 12 |
| 100 8/16 | 14 | 7 3/16 | 123 8/16 | 159 4/16 | 13 | 13 | 7 12/16 | 114 | 152 | 12 |
| 100 | 14 | 7 2/16 | 123 8/16 | 158 15/16 | 13 | 13 | 7 11/16 | 114 | 152 10/16 | 12 |
| 99 8/16 | 14 | 7 2/16 | 123 8/16 | 158 10/16 | 13 | 13 | 7 10/16 | 114 | 151 5/16 | 12 |
| 99 | 14 | 7 1/16 | 123 8/16 | 158 5/16 | 13 | 13 | 7 10/16 | 114 | 151 | 12 |
| 98 8/16 | 14 | 7 1/16 | 123 8/16 | 158 | 13 | 13 | 7 9/16 | 114 | 150 11/16 | 12 |
| 98 | 14 | 7 | 123 8/16 | 157 11/16 | 13 | 13 | 7 9/16 | 114 | 150 5/16 | 12 |
| 97 8/16 | 13 | 7 8/16 | 114 | 150 | 12 | 13 | 7 8/16 | 114 | 150 | 12 |
| 97 | 13 | 7 7/16 | 114 | 149 11/16 | 12 | 13 | 7 7/16 | 114 | 149 11/16 | 12 |
| 96 8/16 | 13 | 7 7/16 | 114 | 149 6/16 | 12 | 13 | 7 7/16 | 114 | 149 6/16 | 12 |
| 96 | 13 | 7 6/16 | 114 | 149 1/16 | 12 | 12 | 8 | 104 8/16 | 141 14/16 | 11 |
| 95 8/16 | 13 | 7 6/16 | 114 | 148 11/16 | 12 | 12 | 7 15/16 | 104 8/16 | 141 9/16 | 11 |
| 95 | 13 | 7 5/16 | 114 | 149 6/16 | 12 | 12 | 7 15/16 | 104 8/16 | 141 4/16 | 11 |
| 95 3/16 | 13 | 7 5/16 | 114 | 149 8/16 | 12 | 12 | 7 15/16 | 104 8/16 | 141 6/16 | 11 |

FIG. 21 *(continue)*

MODULAR STAIRWAY SYSTEM AND KIT THEREFOR

CROSS REFERENCE TO RELATED APPLICATIONS

This application is a Continuation of PCT Application No. PCT/CA2008/001438 filed on Aug. 11, 2008, which claims priority to U.S. Provisional Application No. 60/935,418 and No. 61/064,575 filed, respectively, on Aug. 10, 2007 and Mar. 13, 2008, which are herein incorporated by reference.

FIELD OF THE INVENTION

The present invention relates to stairways and, more particularly, to modular stairways made of pre-fabricated components such as steps, stringers, etc., typically in the form of a kit for assembly on site.

BACKGROUND OF THE INVENTION

Typically, staircases are completely produced on site with the various wood components being cut to size as the staircase is progressively erected on site.

Also, it has been proposed to completely assemble a staircase in the factory such that a pre-assembled staircase is delivered to the construction site for direct and easy installation thereat. Such a modular staircase is disclosed in Canadian Patent Application No. 2,149,981 naming Raymond Couture as inventor and laid-open for public inspection on Nov. 24, 1995.

Furthermore, in Canadian Patent Application No. 2,276,988, also naming Raymond Couture as inventor, and laid-open for public inspection on Dec. 30, 1999, a modular staircase is proposed, which includes a permanent framing made of metallic stringers and vertically extending step supports that are secured along the stringers. Each step support includes upper and front flanges adapted to be secured respectively to a tread and to a riser of each step of the staircase. If the staircase has a partly exposed side, various decorative or finishing wooden components, including treads, risers, false or decorative stringers, mouldings, etc., are provided to cover any exposed structural metallic framework and particularly the stringers.

Moreover, in U.S. Pat. No. 4,422,270 naming Leopold Lapointe and Donat Pelletier as inventors and issued on Dec. 27, 1983, a modular, self supporting flight of stairs is proposed. The flight of stairs described therein comprises at least one pair of stringer units for supporting at least one tread thereon and bolted thereto. The stringer units each comprise a side plate and a fixation plate extending outwardly therefrom and parallel thereto for fixing a fixation of a first unit to a side plate of an adjacent unit by riveting or bolting. A two-part stringer unit comprising intersecting oblong slots allows for step height adjustments.

In U.S. Pat. No. 2,593,683, naming G. W. Lyons as inventor, and issued on Apr. 22, 1953, a vertically adjustable staircase is proposed. The flight of stairs described therein comprises sectional stringers formed of prefabricated sheet metal tread-supporting plates, each plate comprising a vertical body portion, two vertical and parallel longitudinal flanges perpendicular thereto and a horizontal rectangular top flange for supporting a tread thereon and bolted thereto. One of the longitudinal flanges of a given plate comprises a plurality of sets of perforated holes for combining with a set of corresponding perforated holes in an adjacent longitudinal flange of an adjacent plate thereby providing adjustable fastening means therefor.

Furthermore, PCT Patent Publication No. WO 2005/090705-A1 published on Sep. 29, 2005 in the name of Raymond Couture, discloses staircases that are constructed of modular stringers for the on-site installation of the staircases in a residential, commercial or industrial setting. Kits for erecting the staircases include matingly or cooperatively coupling step support units defining the staircase stringers, a set of steps adapted to be mounted thereon, as well as various finishing elements and modules to provide a finished look to the completed staircases. The staircases include self-supporting staircases, linear staircases, curling or spiralling staircases and adjustable variations thereof.

Therefore, it is desirable to provide a modular stairway system, typically in the form of a kit, which can be assembled to erect a stairway on site.

SUMMARY OF THE INVENTION

It is therefore an aim of the present invention to provide a novel stairway system, in the form of a kit.

One aspect of the present invention provides a kit having a step module adapted to be assembled adjacent to other step modules.

Another aspect of the present invention provides a step module including a tread and a riser wherein the riser is adapted to be connected with the tread of another adjacent step module. The connection between the riser of one module and the step of the other module provides a riser-height adjustment mechanism.

One other aspect of the present invention provides a step module including a tread and a riser that can be assembled dry (e.g. without glue) with an adjacent step and riser module. The dry-assembly allows relative adjustments between the adjacent modules.

Another aspect of the present invention provides a step module including a tread and a riser that can be dry-assembled with an adjacent step module. The dry-assembly is adapted to be glued once the adjacent step modules are correctly assembled and in appropriate positions.

A further aspect of the present invention provides, for a step module having a step and a riser, a series of bolts fastened to the tread in a position to interact with the riser such that the riser can be selectively adjusted and fastened to the tread. The bolts is provided in a recess adapted to receive glue to substantially permanently secure the tread to the riser once the riser is properly secured to its associated tread with the series of bolts.

One aspect of the present invention provides a method of assembling step modules without glue, adjusting the position of the riser of one step module in respect with the tread of another adjacent step module and, when the position of the riser in respect with the adjacent tread is properly positioned, applying glue between the riser and the adjacent tread to substantially permanently secure the riser to the tread.

Another aspect of the present invention provides a moulding disposed between stringers and the wall to provide a substantially gap-less finish that follows the contour of the wall. The moulding rests on one side thereof in a groove defined in the stringer, with the moulding being adapted on an opposite side thereof to contact the wall. The moulding is shaped and/or made of a material chosen such as to provide flexibility for the moulding such that it can follow the contour of the wall.

One other aspect of the present invention provides a kit for erecting a stairway comprising a step module and an adjacent step module, the step module comprising a riser and a tread, the riser being adapted to abut the tread on a first side thereof and being adapted to define a fastener-mating portion on a second side thereof, the tread being adapted to be secured atop the riser on one side thereof, the adjacent step module comprising a riser and a tread, the adjacent step module being adapted to be assembled with the step module by engaging a fastener with the fastener-mating portion of the step module and securing the fastener to the tread of the adjacent step module to secure the two step modules together.

Another aspect of the present invention provides a method for building a stairway comprising providing a step module, the step module comprising a riser and a tread, the riser being adapted to abut the tread on a first side thereof and being adapted to define a fastener-mating portion on a second side thereof, the tread being adapted to be secured atop the riser on one side thereof; providing an adjacent step module, the adjacent step module comprising a riser and a tread; and assembling the adjacent step module with the step module by engaging a fastener with the fastener-mating portion of the step module and securing the fastener to the tread of the adjacent step module to secure the two step modules together.

One aspect of the present invention provides a kit for erecting a self-supporting stringerless stairway comprising: a first step module and a second step module, the first step module comprising a riser and a tread, the riser being adapted to abut the tread on a first side thereof and being adapted to define a fastener-mating portion on a second side thereof, the tread being adapted to be secured atop the riser on one side thereof, the second step module comprising a riser and a tread, the tread being adapted to receive a fastener on a first side thereof and to be secured atop the riser on a second side thereof, the second step module being adapted to be assembled with the first step module by engaging the fastener with the fastener-mating portion of the first step module and with the tread of the second step module.

An additional aspect of the present invention provides a step module for erecting a stairway, the step module comprising a tread comprising a foot contacting surface, a proximal side surface, a distal side surface and lateral side surfaces, the tread comprising a fastener-receiving portion disposed on the distal side surface for substantially orthogonally securing a fastener thereto, and a riser comprising a proximal surface, an upper side surface and a lower side surface, the riser comprising a fastener-mating portion substantially orthogonally disposed on the proximal surface in a vicinity of the lower side surface, the fastener-mating portion and the fastener-receiving portion being adapted to cooperate with the fastener to secure two step modules together and to adjust a distance between the treads of the two step modules.

An aspect of the present invention provides a riser for use in a step for erecting a stairway, the riser comprising a proximal surface, opposed side surfaces and opposed upper and lower surfaces, the proximal surface being provided with an elongated opening adapted to receive a fastener to secure a tread thereto, the elongated opening being adapted to provide a distance adjustment between treads of adjacent steps.

Another aspect of the present invention provides a riser for use in a step for erecting a stairway, the riser comprising opposed upper and lower ends, the lower end being provided with an elongated opening adapted to receive a fastener to secure a tread thereto, the elongated opening being adapted to provide a distance adjustment between treads of adjacent steps.

Another aspect of the present invention provides a tread for use in a step for erecting a stairway, the tread comprising a foot supporting surface, opposed side surfaces and opposed distal and proximal surfaces, the distal surface being provided with a securing material receiving portion adapted to receive a securing material therein when at least a portion of the stairway is dry-assembled to substantially permanently secure the tread to a corresponding adjacent riser.

Another aspect of the present invention provides a tread for use in a step for erecting a stairway, the tread comprising a foot supporting surface, opposed front nose and rear ends, the rear end being provided with a securing material receiving portion adapted to receive a securing material therein when at least a portion of the stairway is dry-assembled to substantially permanently secure the tread to a corresponding adjacent riser.

Other aspects, objects, advantages and features of the present invention will become more apparent upon reading of the following non-restrictive description of embodiments thereof, given by way of example only with reference to the accompanying drawings.

BRIEF DESCRIPTION OF THE DRAWINGS

In the appended drawings:

FIG. 21 (on two sheets) is a table of rises and steps in accordance with the schematic of FIG. 20.

DESCRIPTION OF ILLUSTRATIVE EMBODIMENT(S) OF THE INVENTION

With reference to the appended drawings, a stairway S constructed from a stringer and step support kit in accordance with an illustrative embodiment of the present invention will now be presented. The stairway S is adapted to be erected on site, using components of the kit to be described hereinafter, and for instance on a flooring F and, on one side thereof, against a wall W in the case of a stairway S that has an exposed side, as herein illustrated.

Figure 1:
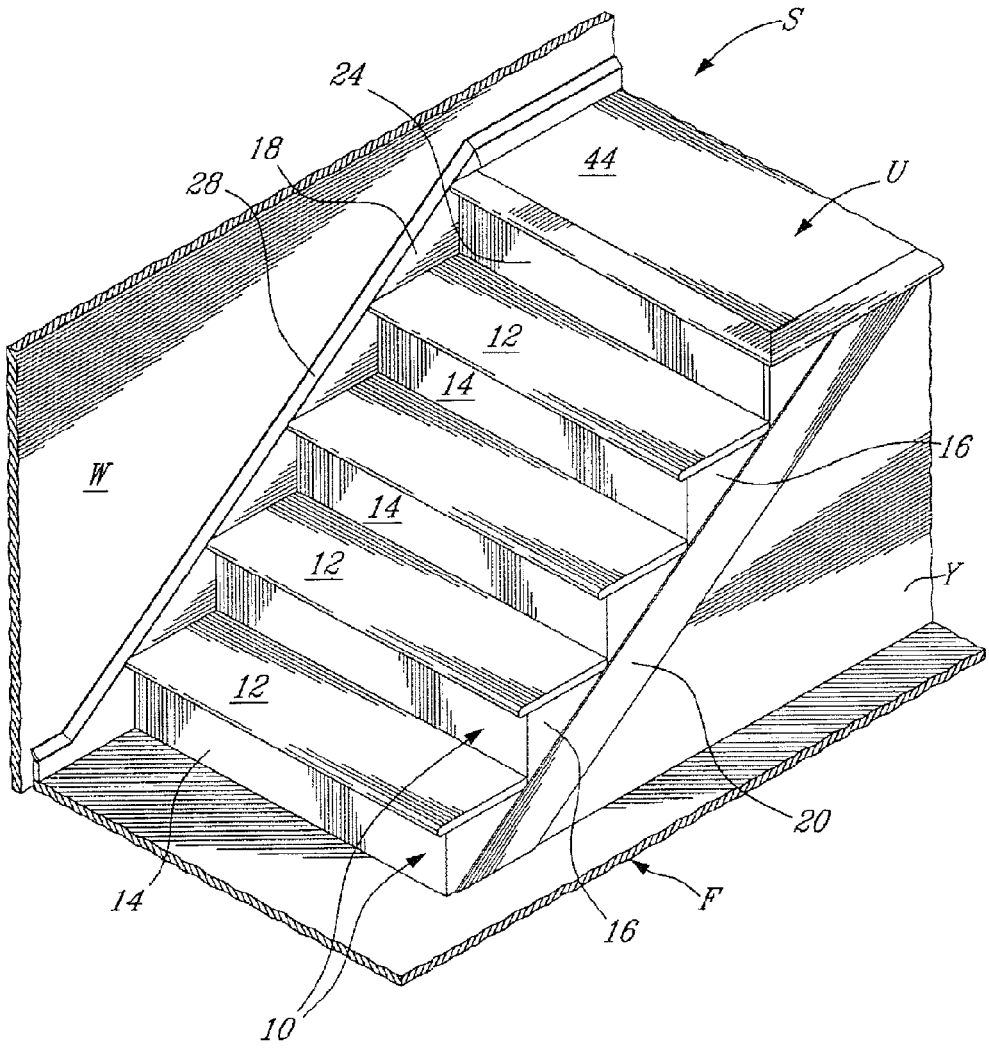
FIG. 1 is a perspective view of a stairway, shown in an assembled state thereof, constructed from a kit in accordance with an illustrative embodiment of the present invention, wall and floor portions being also herein shown.
Figure 2:
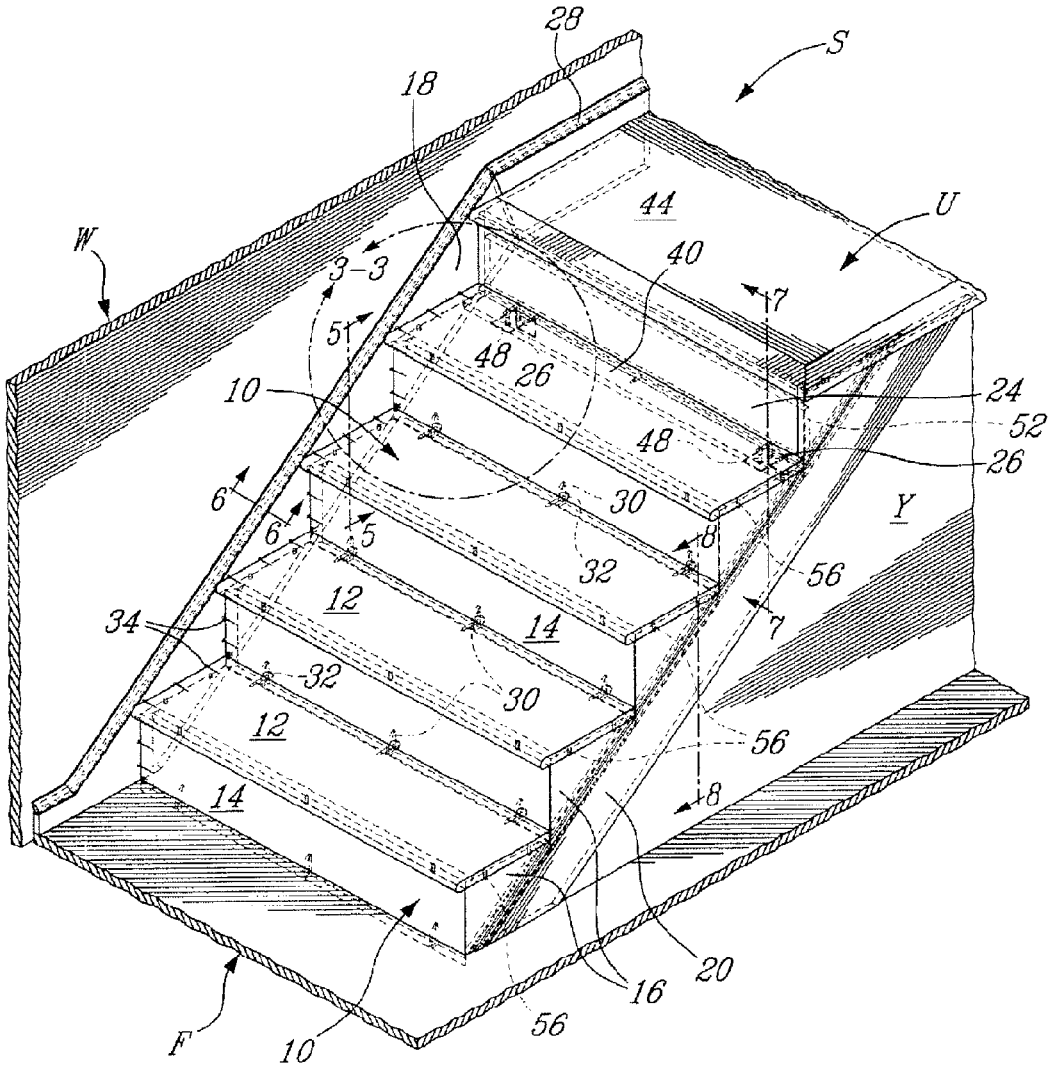
FIG. 2 is a perspective view of the stairway of FIG. 1, illustratively showing various details of components thereof.
Figure 3:
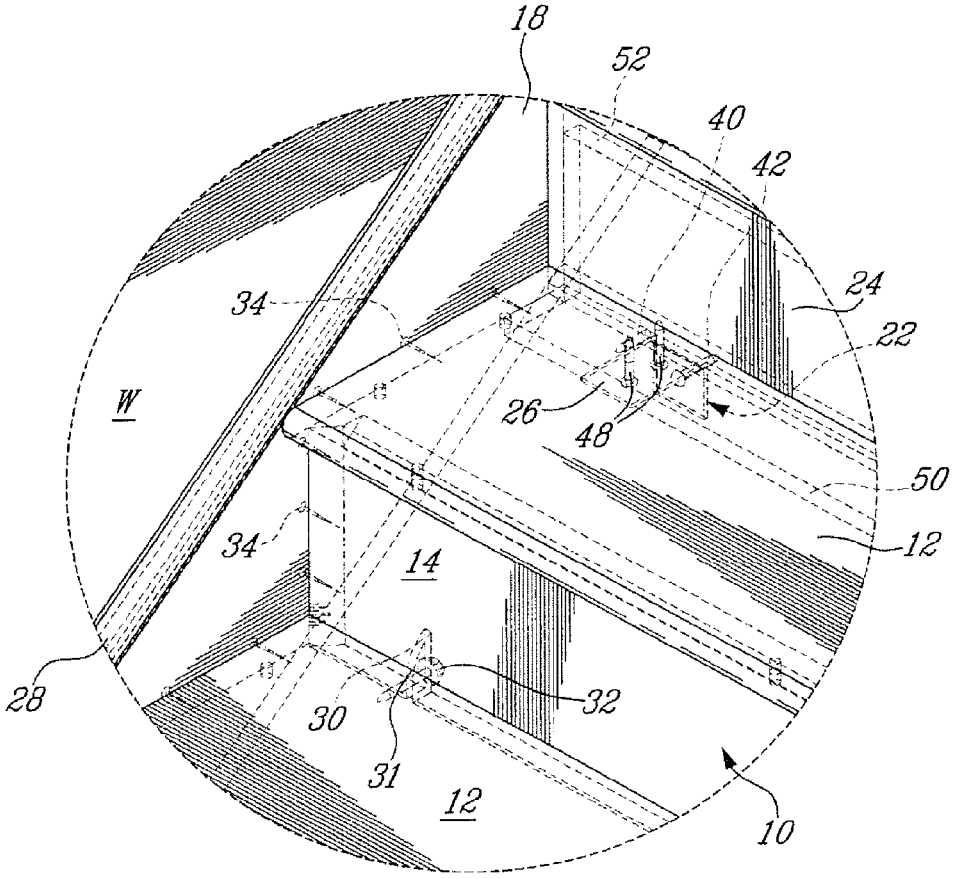
FIG. 3 is an enlarged perspective view of the portion of the stairway defined by bubble 3-3 in FIG. 2.
Figure 4:
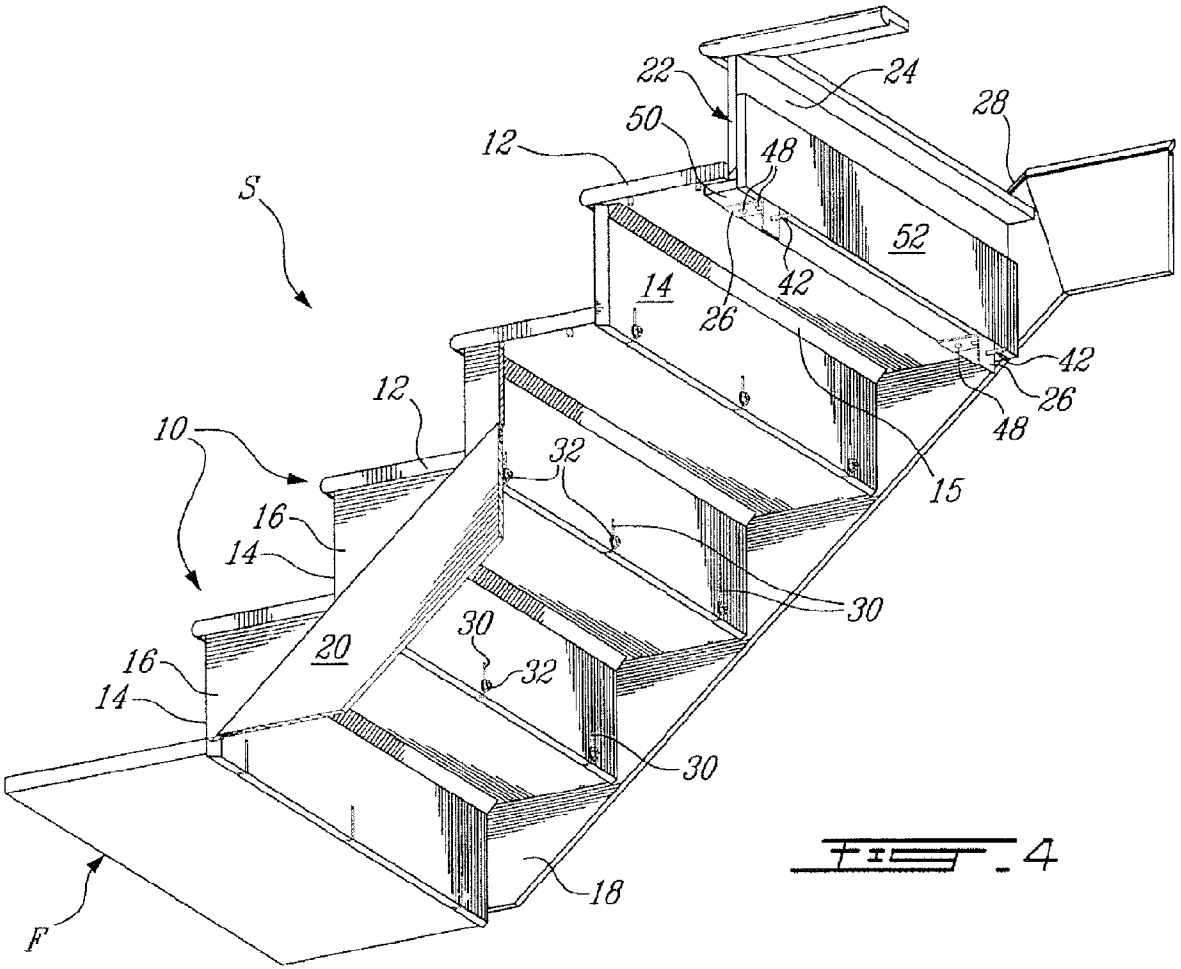
FIG. 4 is a bottom rear perspective view of part of the stairway of the illustrative embodiment of the present invention shown in FIGS. 1 and 2.

The kit is comprised, for example, of six basic components, that is (1) a set of steps 10, each comprising a tread 12 and a riser 14 that are pre-assembled together, the tread 12 atop the riser 14, with an elongated triangular support 15 (FIGS. 4 and 7) being mounted on a hidden side of the junction of the tread 12 with the riser 14; (2) finishing triangular members 16 for the exposed side of the stairway S; (3) a structural and finish stringer 18 (e.g. in the form of a board) adapted to be mounted on the wall side (on the left-hand side in FIG. 1) of the stairway S, the stringer 18 being, for instance, 8 inches wide and supplied in lengths of 8 feet; (4) a finishing board 20 adapted to be mounted on the exposed side (on the right-hand side in FIG. 1) of the stairway S, the finishing board 20 being, for instance, 6 inches wide and supplied in lengths of 8 feet; (5) an anchoring unit 22 (see FIGS. 4 and 7) for joining an upper end of the stairway S to an upper floor structure 24, the anchoring unit 22 including a finish riser 24 and a pair steel angle brackets 26; and (6) a moulding 28 adapted to be positioned atop the stringer 18 and to lean against and to follow the contour of the wall W for hiding imperfections in the wall W.

The steps 10, the finishing triangular members 16, the structural and finish stringer 18, the finishing board 20, the anchoring unit 22 and the moulding 28 are typically made of wood products, except for instance for the steel angle brackets 26 of the anchoring unit 22. The present kit thus allows for various decorative finishes.

Three (3) vertical "grooves" 30 are defined at the base of the risers 14 of the steps 10, as well seen in FIGS. 2, 3, 4, 7, 8, 9, 10 and 11. These grooves 30 can be slots or oblong holes made in the riser material to allow for a height adjustment between the steps 10 to be done from behind the stairway S, using one bolt 32 per groove 30. Each bolt 32 is driven, from behind the stairway S, through the bottom part of the riser 14 of one step 10 and into a rear end of the tread 12 of an adjacent step 10, thereby allowing for an easy minimum vertical adjustment, from 0 to ¾" per step 10. The groove 30 also provides an access through the riser 14 to apply glue 74 to permanently secure the tread 12 with the riser 14.

The kit of the present invention provides the user with the possibility of erecting a stairway in various heights and shapes, using the same components. Some of these components require a few simple cuts, namely to the ends of the structural and finish stringer 18 and to the finishing board 20.

Before ordering the kit, precautions must be taken. For instance, the orientation of the stairway (right or left) is first determined and established from the bottom of the stairway to be erected. Second, the total height of the stairway opening should be measured from floor finish to floor finish (F.F. to F.F.), herein from F to U.

Before starting to assemble and erect the stairway S, the user should check and correct, if necessary, the squaring and leveling of the walls W to which the stairway S will be installed as well as the flooring F. The user must substantially precisely measure the height of finished floor to finished floor (F.F. to F.F.) between which the stairway S will be erected. If the finish of one or the other floors is missing, the user has to simulate the finish by using, for instance, a small strip of wood (of a same thickness as that of the floor finish to come).

Stair Angle Based On Rise and Run

| | Run | | | | | | | | |
|---|---|---|---|---|---|---|---|---|---|
| Rise | 10" | 10.5" | 11" | 11.5" | 12" | 12.5" | 13" | 13.5" | 14" |
| 5" | 27° | 25° | 24° | 23° | 23° | 22° | 21° | 20° | 20° |
| 5.25" | 28° | 27° | 26° | 25° | 24° | 23° | 22° | 21° | 21° |
| 5.5" | 29° | 28° | 27° | 26° | 25° | 24° | 23° | 22° | 21° |
| 5.75" | 30° | 29° | 28° | 27° | 26° | 25° | 24° | 23° | 22° |
| 6" | 31° | 30° | 29° | 28° | 27° | 26° | 25° | 24° | 23° |
| 6.25" | 32° | 31° | 30° | 29° | 28° | 27° | 26° | 25° | 24° |
| 6.5" | 33° | 31° | 30° | 29° | 28° | 27° | 27° | 26° | 25° |
| 6.75" | 34° | 33° | 32° | 30° | 29° | 28° | 27° | 27° | 26° |
| 7" | 35° | 34° | 32° | 31° | 30° | 29° | 28° | 27° | 27° |
| 7.25" | 36° | 35° | 33° | 32° | 31° | 30° | 29° | 28° | 27° |
| 7.5" | 37° | 36° | 34° | 33° | 32° | 31° | 30° | 29° | 28° |
| 7.75" | 38° | 36° | 35° | 34° | 33° | 32° | 31° | 30° | 29° |

Figure 20:
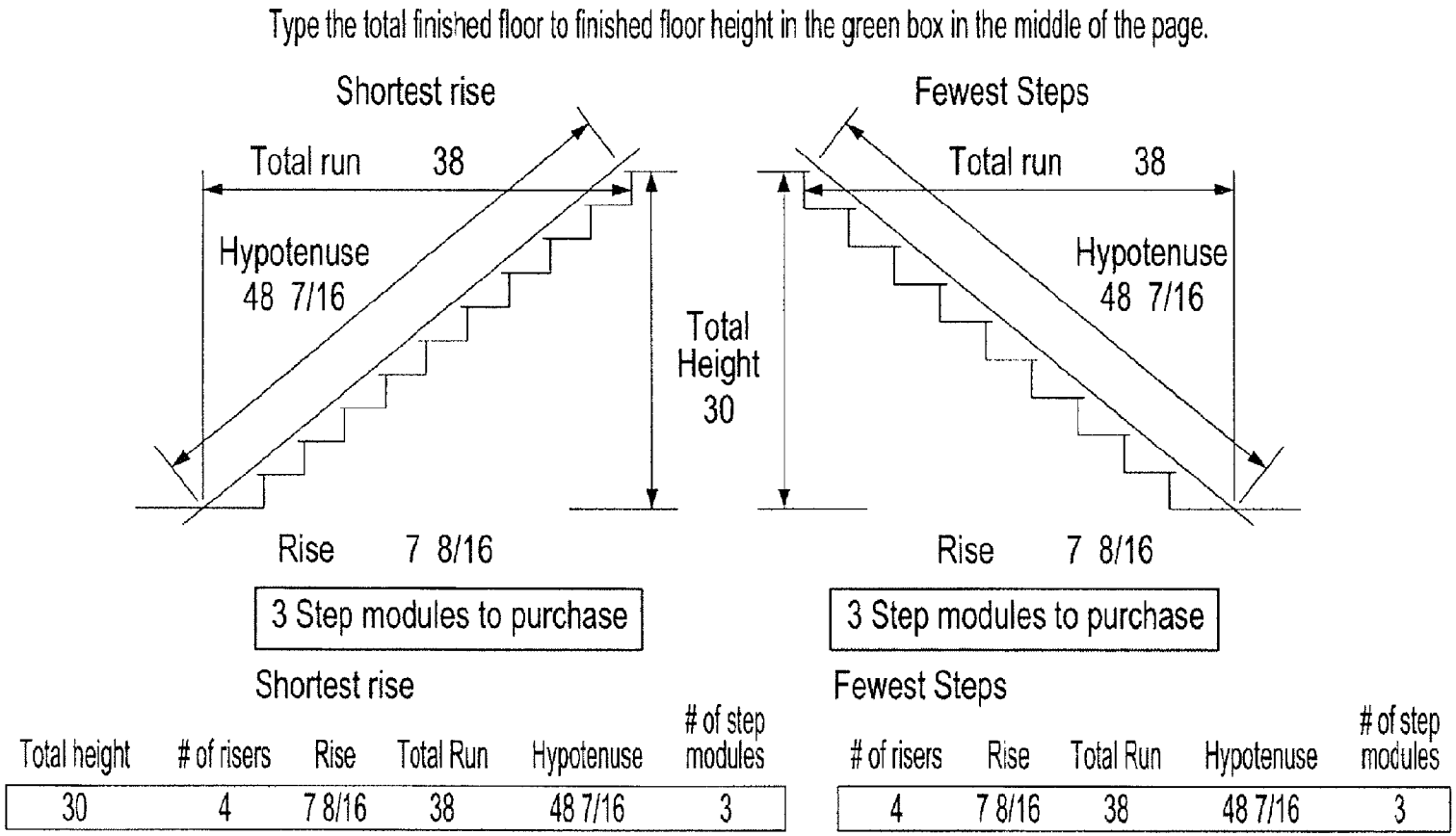
FIG. 20 is a schematic of a stairway with a table of rises and steps.

To establish the height of the risers 14, a chart such as that enclosed above and on FIGS. 20 and 21 can be used. These charts show how to establish the height of the risers 14 from the floor-to-floor height measurements. Riser height means therein height top-to-top of the steps 10 or treads 12. The present pre-fabricated stairways are typically available in two standard width sizes, namely 36 inches and 42 inches.

After having established the height of the risers 14 (e.g. with the aforementioned chart), the user then places the step modules or steps 10 upside down on a table and attaches them together in a staircase-form using the bolts 32 although the bolts 32 are not tightened firmly. The user then begins assembly of the stairway S, starting with its attachments at the base of the riser 14 of a first step 10 and the back of the tread 12 of a second step 10 located adjacent under the first step. The relative position of the steps 10 is thus adjusted by sliding the steps 10 along each other, guided by the bolts 32 engaged in the grooves 30 defined in the risers 14. Once the steps 10 are precisely positioned, a small bead of for instance P.L. 400 adhesive is placed and the three (3) bolts 32 for each assembly of a pair of adjacent steps 10 are tightened to retain the steps 10 in their exact relative position.

As best seen on FIGS. 9A, 9B, 10 and 11, a cavity 76 is disposed on the end portion of the tread 12 at the base of the bolts 32 to receive glue 74. The cavity 76 extends transversally beyond the width of the groove 30 to ensure that glue 74 will contact both the tread 12 and its associated riser 14. Alternatively, the cavity 76 can have the shape of a groove 80 (see FIGS. 9A and 9B) along the side of the tread 12, or being a round recess 82 (see FIG. 9A), to facilitate the manufacturing of the cavity 76. The cavity 76 also provides a space to glue the bolt 32 and its nut therein to the tread 12 and riser 14 to provide an even more rigid assembly. The inside wall of the slot 30 toward the proximal side of the riser 14 is provided with an angle, or a radius 31 (see FIGS. 3, 7, 8 and 9A), opening toward the rear side of the riser 14. The angle or the radius 31 provides room to insert the tip of a glue 74 container behind the nut and washer assembled to the bolt 32. Therefore, once the steps 10 have been adjusted relative to one another so as to provide the desired height for the stairway S, the risers 14 are "locked" to the treads 12 of respective adjacent lower steps 10, via the bolts 32. Once the adjustment step modules 10 are "locked" together glue is applied to permanently secure the assembly.

The precise adjustment (both exactly the same measurement) of the two (2) riser positioning clamps (not herein shown, but used temporarily to attach the steps 10 together until the bolts 32 are tightened) is important because it is one of the main operations to assure the self alignment of the whole stairway S. This type of alignment made without glue is called dry alignment. A dry alignment is a stairway erection that can be adjusted if needed before the erection is permanently secured in place.

FIGS. 9A through 11 also teach a gluing pattern 72 where glue 74 is applied to secure the triangular element 16 to the riser 14 and to the tread 12. It is understood that the triangular element 16 is preferably disposed in the vicinity of the sides of the step and that vicinity, within the scope of the present disclosure, encompass to dispose the triangular element 16 on the side edge of a step. Additional cavities 70 are provided on the underside lateral edge of the tread 12. These cavities 70 are disposed to be contiguous with one side of the triangular element 16 to facilitate application of the glue 74 and increase the glued surface area between the tread 12 and the triangular element 16. The number and the shape of the cavities 70 can differ from what is actually depicted on the Figures without departing from the scope of the present invention.

The user then installs the upper part of the stairway S, which is the anchoring unit 22. The finish riser 24 is glued (with, for instance, a bead of white carpenter glue) and fastened with, for example, four (4) to five (5) #8×1½" wood screws 40 (see FIG. 7) to the back of the tread 12 of the uppermost step 10. It is noted that the finish riser 24 should be cut at the same height as the height of other assembled risers 14. This operation shall be undergone prior to assembly of the last step.

To assemble the stringer 18 to the now assembled steps 10, it is preferable to position the stairway S on its side, i.e. with a wall side thereof facing upwardly. Then, for instance, a fine bead of white carpenter glue is applied to the ends of the treads 12 and risers 14. Thereafter, the stringer 18 is fastened into place along the steps 10 using screws 34 (see FIGS. 2 and 4), ensuring that the upper grooved side of the stringer 18 is flush with the step nosing. As to the screws 34, there are used, for instance, three (3) screws #8×1½" for each tread 12 and riser 14. For example, the user can start by placing one screw 34 at ¾" from the edge of the stringer 18 at each step nosing. Afterwards, the user can install the remaining required screws 34. It is noted that a small template (not shown) is provided to mark the screw positioning. As the stringer 18 is now assembled to the steps 10, any stringer surplus can be cut at both ends of the stairway S.

The stairway S can now be mounted in place. The two steel angle brackets 26 are first fastened with screws 42 to the upper floor structure U, approximately 9 inches lower than a finished surface 44 of the upper floor structure U (i.e. 7/1;2"+ 1½"). The top of the stairway S is then simply dropped onto these two steel angle brackets 26. Once the stairway S is adjusted, leaving an equal space of ±¼" from stair to wall surface (using wood shingle shims 46, FIG. 6), the stairway S can be fastened firmly to the upper floor structure U, using for instance five (5) #8×2" wood screws 48 (FIG. 7), and to the wall studs, using for instance two (2) #8×2" wood screws per wall stud, not shown.

Figure 7:
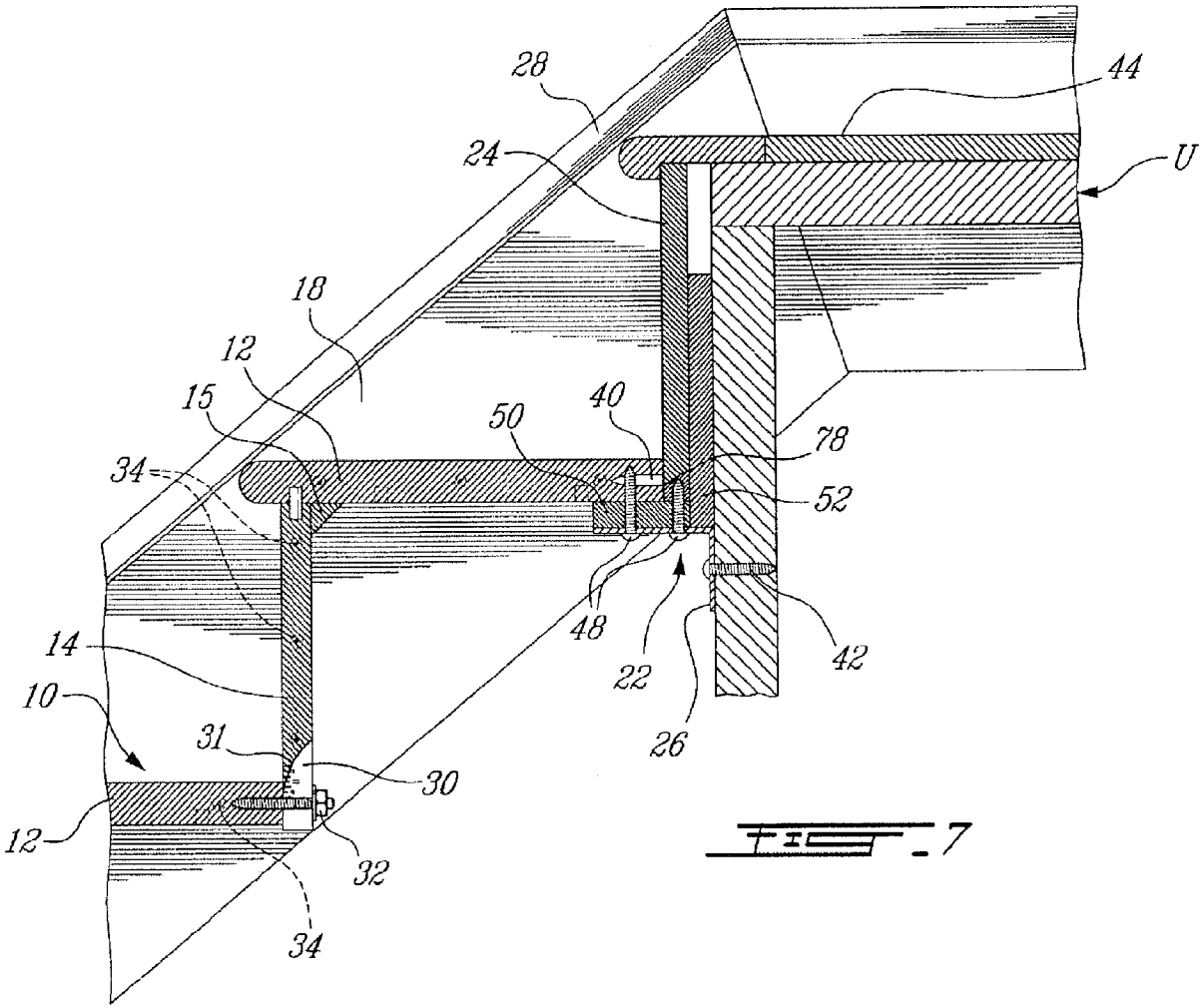
FIG. 7 is a vertical cross-sectional view taken along line 7-7 of FIG. 2.

One or more appropriate spacers 50 can be used, as seen in FIG. 7. Then, a last riser 52 which completes the stairway S under the nose of the upper floor structure U is simply slipped into place. The back side of the riser 52 must be pre-glued and firm pressure applied. One can apply two (2) heavy beads of adhesive P.L. 400, laid horizontally.

Figure 5:
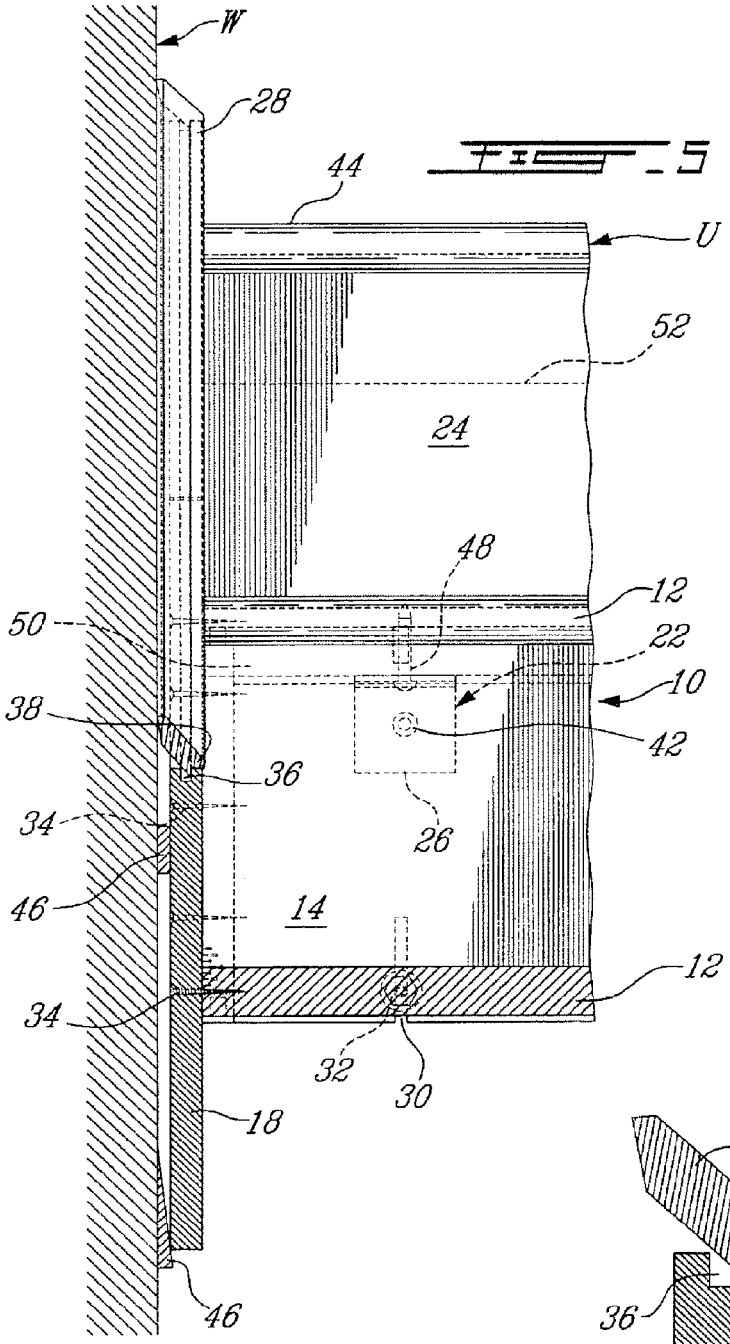
FIG. 5 is a vertical cross-sectional view taken along line 5-5 of FIG. 2.
Figure 6:
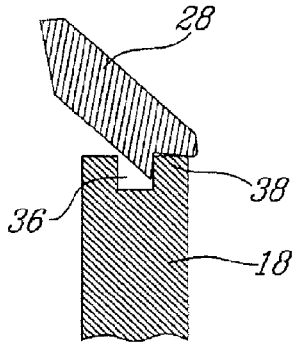
FIG. 6 is an angled cross-sectional view taken along line 6-6 of FIG. 2.

The finishing moulding 18, wall side, can now be installed on the stringer 18. To do so, the upper end of the stringer 18 defines a longitudinal groove 36, whereas a lower end of the moulding 28 is provided with a longitudinal cut-out 38, as best seen in FIG. 6. The cut-out 38 engages partly the groove 36 and also sits atop the stringer 18 with the moulding 28 being angled upwardly towards the wall W and leaning thereagainst. As it can be appreciated from FIG. 5, the narrow thickness of the moulding 28 in conjunction with its angle toward the wall W provides sufficient flexibility to the moulding 28 to follow the contour of the wall W and prevent apparent gaps between the moulding 28 and the wall W.

Figure 16:
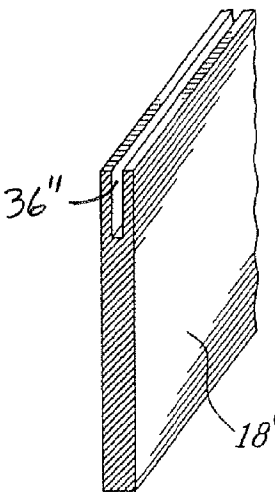
FIG. 16 is a perspective view of a variant stringer.
Figure 15:
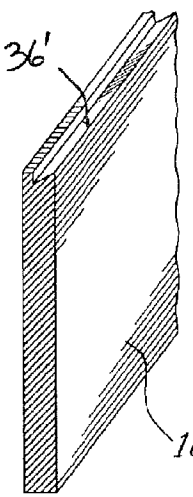
FIG. 15 is a perspective view of the stringer of FIG. 14.
Figure 14:
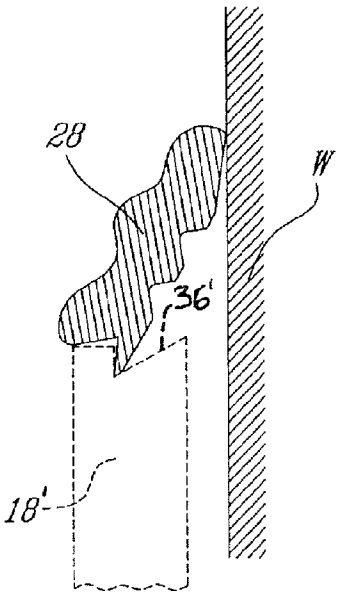
FIG. 14 is a sectional view of a moulding disposed between a stringer and a wall.
Figure 19:
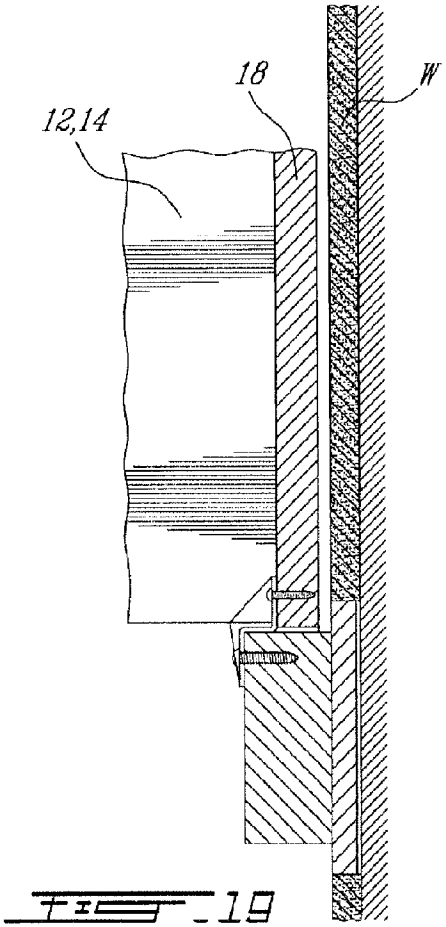
FIG. 19 is a front elevational sectional view of a stringer.
Figure 18:
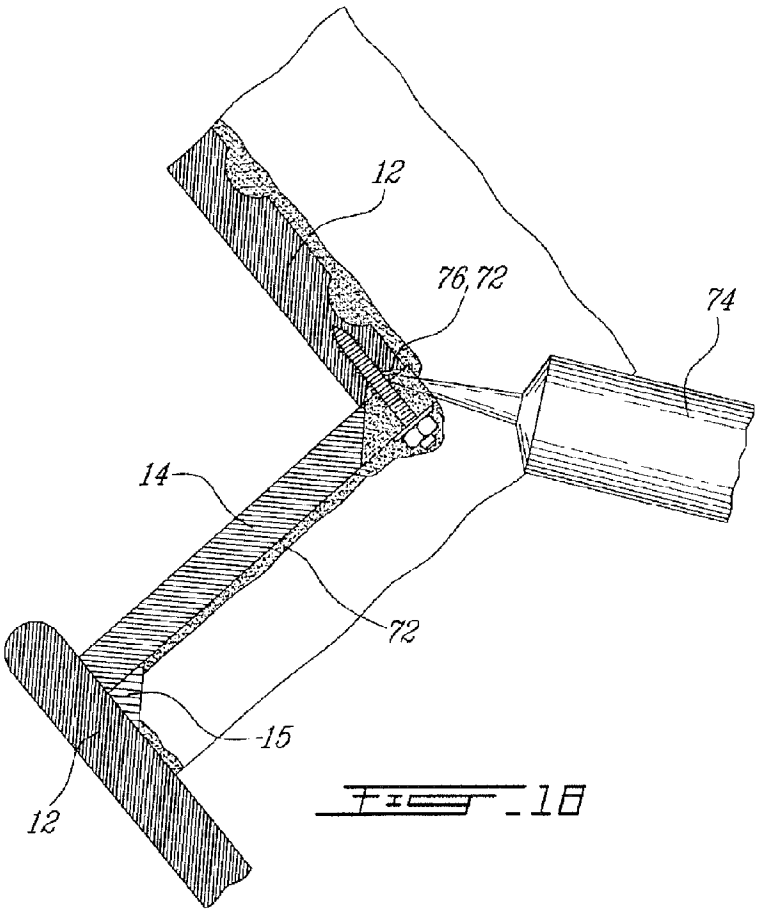
FIG. 18 is a left elevational sectional view of a tread and riser.

Small beads of, for instance, P.L. 400 adhesive are laid in the groove 36 of the stringer 18 and at the upper back of the moulding 28. Small screws and plastic washers are provided to keep the moulding 28 in place during the setting of the adhesive. The moulding 28, with this inclination, thus hides surface variations in the wall W (and gaps produced thereby between the wall W and the stringer 18 of the moulding 28) for ensuring an easy and almost perfect adjustment. FIGS. 14 to 16 show variant stringers 18' and 18" provided respectively with grooves 36' and 36".

Now turning to the exposed side of the stairway S, it is noted that the exposed side of a stairway is usually closed (underneath) by a small support wall Y (see FIGS. 1 and 2) onto which the stairway S rests. In the case where the underside of a stairway is open, e.g. if there is another stairway going to a lower floor, the small support wall Y is then replaced by a small beam, which dimensions will vary according to the length of the staircase.

For example, if such a stairway has a length of 6 to 8 steps, two (2) pieces of 2"×6" studs will be sufficient to provide an adequate support for the stairway. In both cases, ⅝" thick small plywood brackets are furnished to join the support wall Y or the beam to the back step corner and riser, which are simply screwed under the interior face; once the adhesive is set, this will prevent vibrations and squeaking of the stairway S. It is noted that this operation should be done after the stairway S has been put in place and before the installation of the triangular elements 16 and of the finishing board 20.

Figure 8:
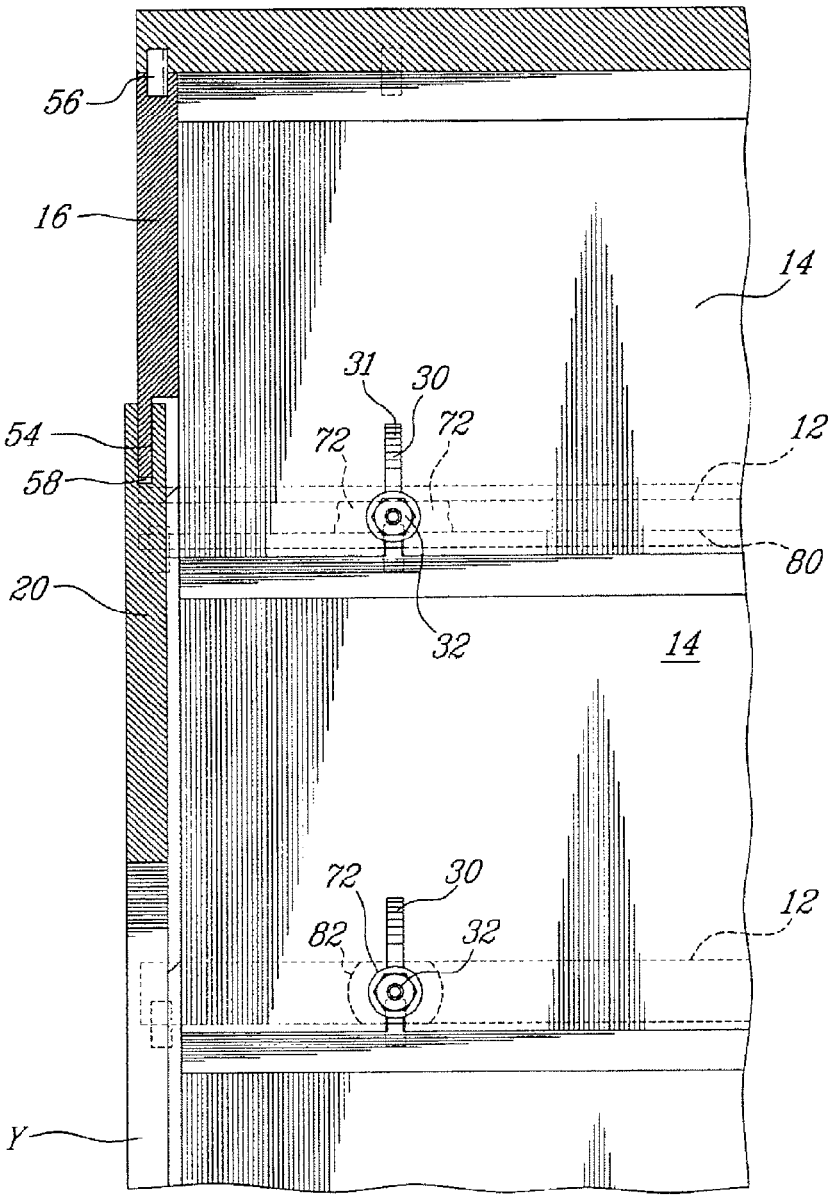
FIG. 8 is a vertical cross-sectional view taken along line 8-8 of FIG. 2.
Figures 9A, 9B:
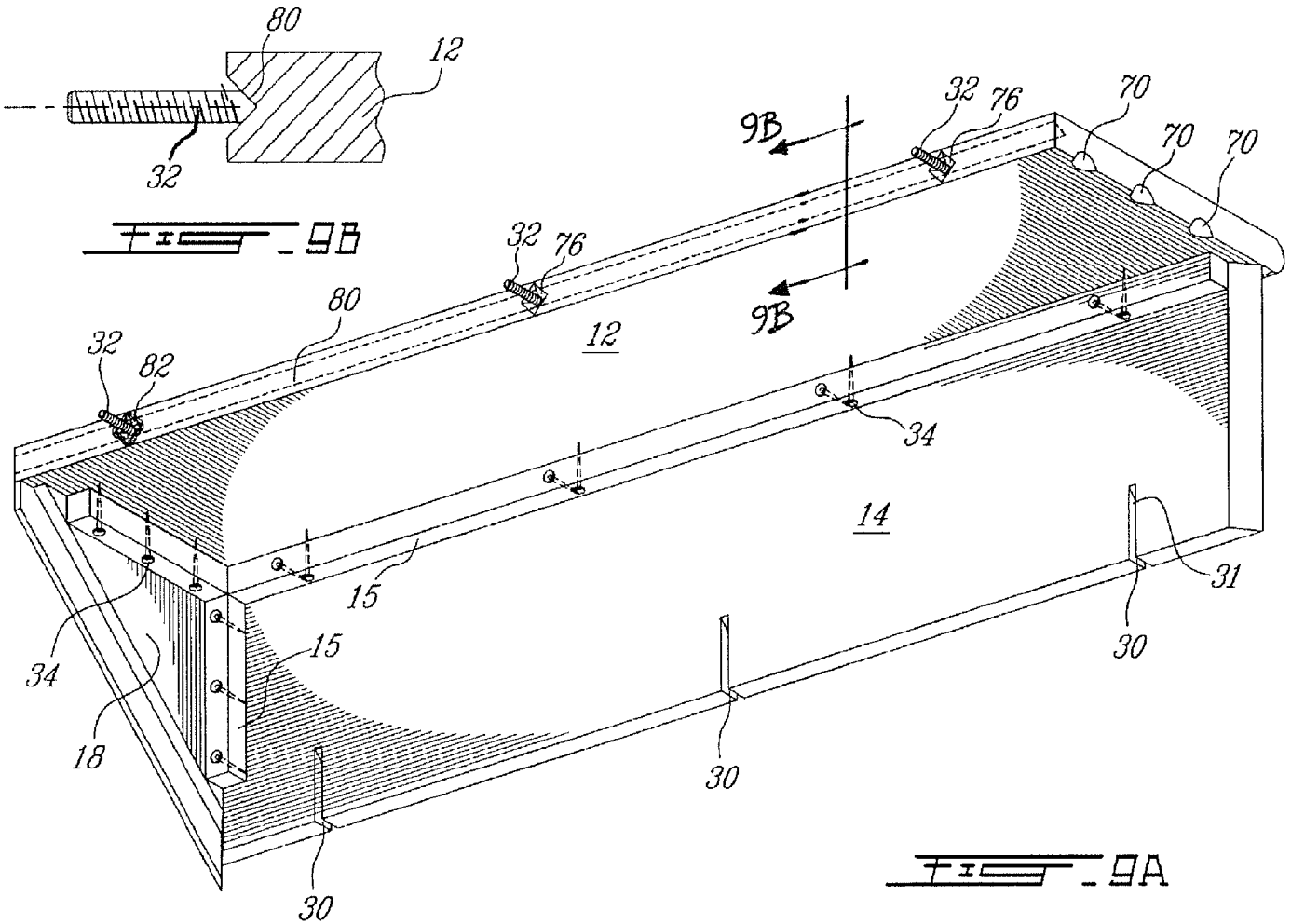
FIG. 9A is a perspective view from underneath of an assembled tread and riser.
FIG. 9B is a cross-section taken along line 9B-9B of FIG. 9A.
Figure 10:
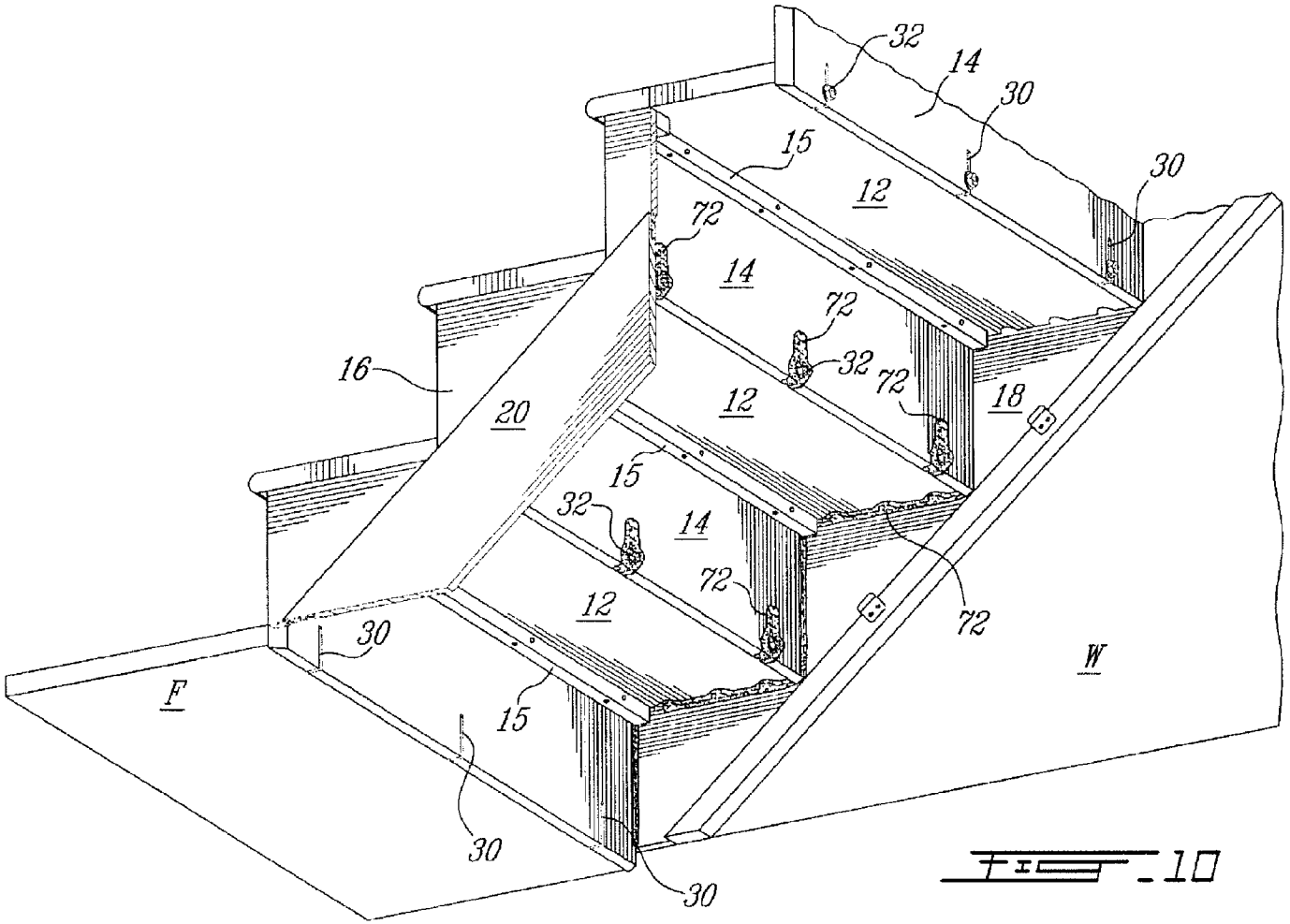
FIG. 10 is a perspective view from underneath of a series of assembled step modules.
Figure 11:
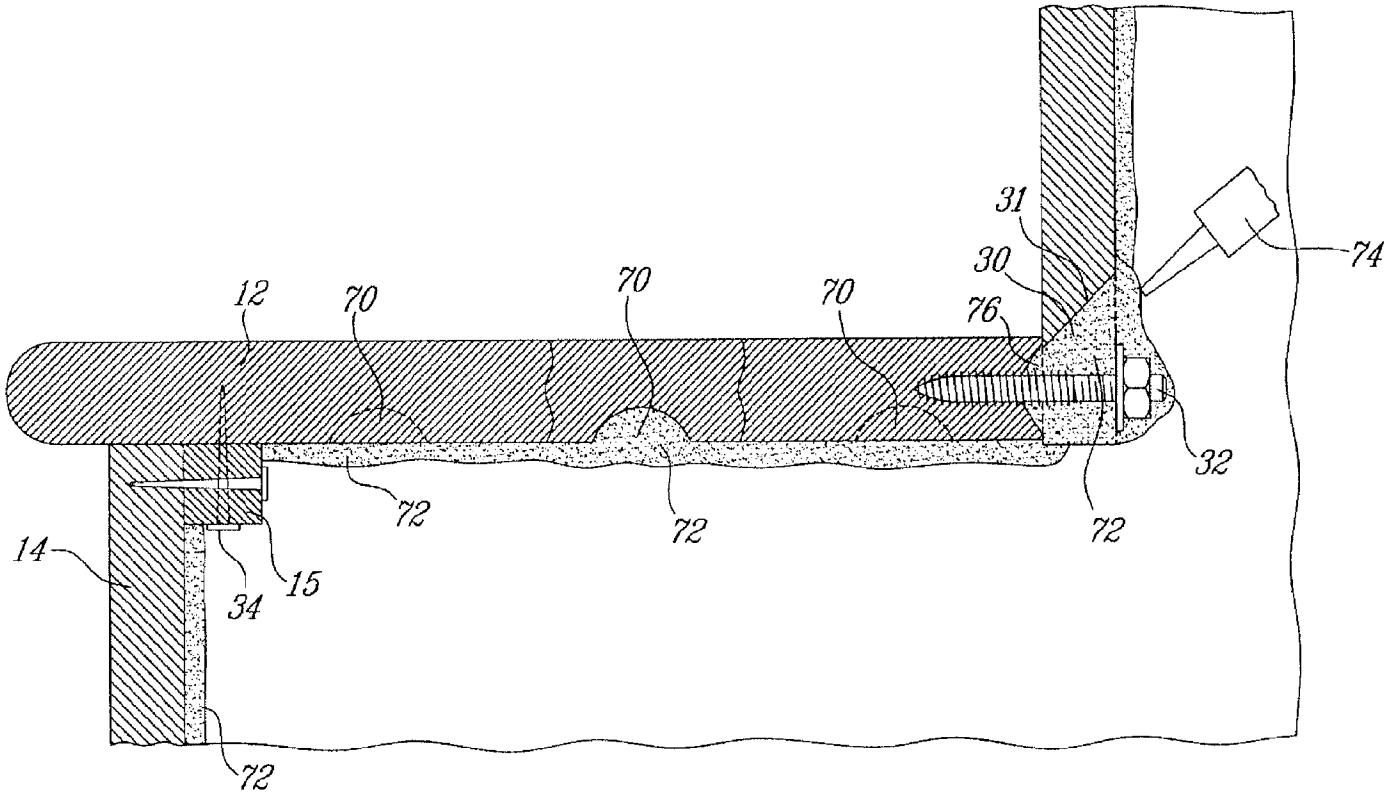
FIG. 11 is a left side elevational sectional view of an assembled tread and riser as depicted on FIG. 9A.
Figure 13:
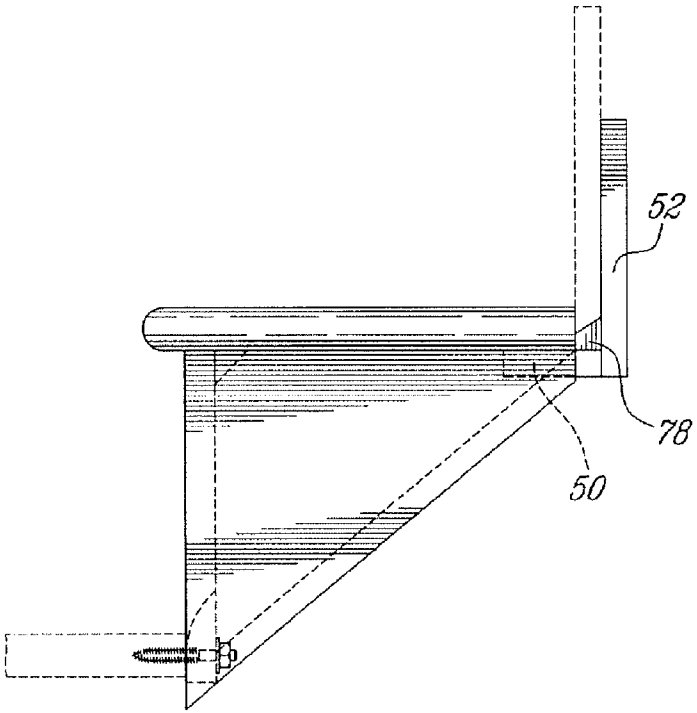
FIG. 13 is a left side elevational view showing inter alia an uppermost riser of a series of assembled step modules.
Figure 12:
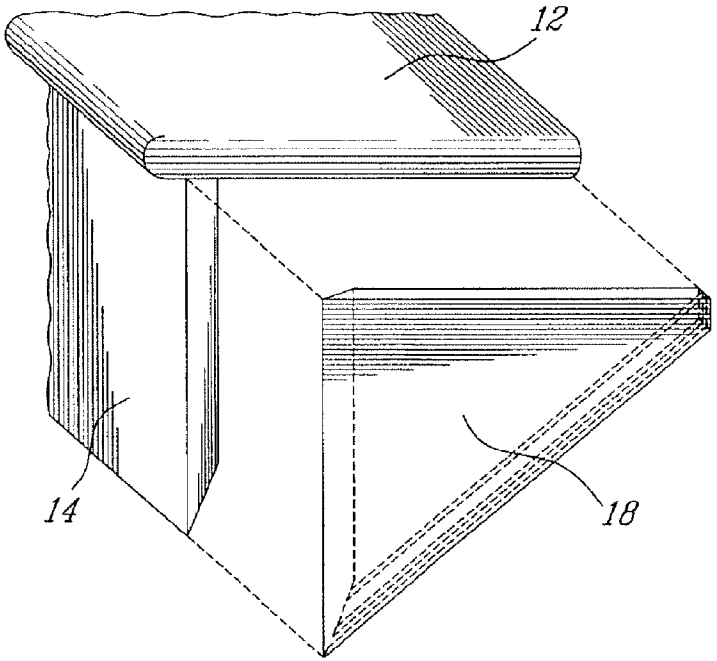
FIG. 12 is a perspective view depicting a step module with an exploded stringer.
Figure 17:
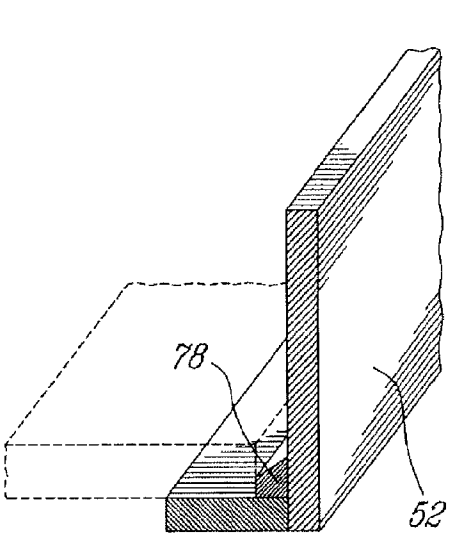
FIG. 17 is a perspective view of the uppermost riser of a staircase.

At this stage, the small finishing triangular elements 16 are installed to close the angles (triangular openings) between the back ends of the risers 14 and the exposed ends of the treads 12. Each triangular element 16 defines a lower tongue 54 (FIG. 8). A fine bead of P.L. 400 adhesive can be applied to the angled side and to the top side of the triangular element 16, this top side being provided with small dowels 56 which are adapted to register with pre-drilled holes defined under the end of the tread 12 so as to assemble the triangular element 16 to the tread 12. A light pressure will suffice to secure it in place. This same operation will apply to all other triangular elements 16. Adhesive can also be provided on the front vertical sides of the triangular elements 16 so as to also glue them to the back of the risers 14. The triangular element 16 substantially increases the rigidity of the assembled step by further securing the tread and the riser together. Each step has its pair of associated triangular elements 16 disposed on each lateral side of the step thus increasing the overall rigidity of the whole stairway.

Now there remains the finishing board 20 to be installed. The finishing board 20 defines an upper deep groove 58 (FIG. 8) which is adapted to receive and conceal the tongues 54 of the triangular elements 16, once assembled. As well as solidifying the whole unit, the finishing board 20 will hide any disparities caused by the height of the risers 14 that has been chosen for the stairway S. Before being put into place, a lower end of the finishing board 20 needs to be cut at the surface level of the flooring F. Once it has been verified that that the finishing board 20 can slide in and fit in well and that the upper part of the finishing board 20 touches all back inferior corners of the steps 10, the finishing board 20 is removed and a bead of adhesive is applied into the groove 58, before the finishing board 20 is put back firmly into place, in its position shown in FIGS. 1 and 2. The finishing board 20 is then held in place until the, for instance, P.L. 400 adhesive is cured (a few minutes). The user should ensure, while pressing the finishing board 20 in place, that it is vertically level.

Finally, excess white carpenter glue can be simply cleaned with a wet cloth, whereas excess P.L. 400 adhesive coming out of joints can be simply cut with a blade, after initial curing. The user should let the adhesive cure for a day before subjecting it to heavy use.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of illustrative embodiments thereof, it can be modified, without departing from the spirit, scope and nature of the subject invention. Indeed, various modifications thereof will be apparent to those skilled in the art without departing from the spirit and scope of the invention.

What is claimed is:

1. A kit for erecting a stairway comprising:

a first step module and an adjacent second step module, the first step module comprising a first riser and a first tread, the first riser being mounted on a first side thereof to at least near a front edge of the first tread and comprising a vertical and elongated slot on a second side thereof, the first tread being secured atop the first riser on one side thereof, the adjacent second step module comprising a second riser and a second tread, the second riser mounted on a first side thereof to at least near a front edge of the second tread and the second tread being secured atop the second riser on one side thereof and comprising a rear edge thereof adapted to receive a fastener, the adjacent second step module being adapted to be assembled with the first step module by engaging the fastener with the vertical slot of the first step module and securing the fastener to the rear edge of the second tread of the adjacent step module to secure the two step modules together, wherein the vertical slot comprises an inside wall that is angled opening along an upward slope away from the second tread of the adjacent second step module thereby defining a removable tip engaging for the second tread.

2. The kit for building a stairway of claim 1, wherein the vertical slot is adapted so that the fastener, when engaged therein, extends substantially perpendicularly to a vertical plane of the first riser.

3. The kit for building a stairway of claim 1, wherein the vertical slot is adapted to provide a riser height adjustment between the step modules.

4. The kit for building a stairway of claim 3, wherein the riser height adjustment is about between 0 millimeter and 25 millimeters long.

5. The kit for building a stairway of claim 1, wherein the slot is a plurality of slots and the fastener is a plurality of fasteners.

6. The kit for building a stairway of claim 1, wherein at least one of the step modules further comprises a support member disposed on a hidden side of the step, between the tread and the riser, to further secure the tread with the riser.

7. The kit for building a stairway of claim 1, wherein at least one of the step modules further comprises a substantially triangular junction element adapted to be disposed between the tread and the riser to further secure the step with the riser.

8. The kit for building a stairway of claim 7, wherein the step modules defines lateral sides, the substantially triangular junction element being adapted to be disposed in a vicinity of a lateral side.

9. The kit for building a stairway of claim 7, wherein an interface between the substantially triangular junction element and at least one of the tread and the riser is adapted to receive a securing material.

10. The kit for building a stairway of claim 9, wherein the interface further defines a securing material receiving portion.

11. The kit for building a stairway of claim 9, wherein the securing material is glue.

12. The kit for building a stairway of claim 1, wherein the two step modules are adapted to be dry-assembled before being permanently secured.

13. The kit for building a stairway of claim 1, wherein an interface between the two step modules is adapted to be further secured with a securing material.

14. The kit for building a stairway of claim 13, wherein the securing material is glue.

15. The kit for building a stairway of claim 13, wherein the interface further defines a securing material receiving portion.

16. The kit for building a stairway of claim 15, wherein the securing material receiving portion at least partially surrounds the vertical slot.

17. The kit for building a stairway of claim 15, wherein the securing material is adapted to be introduced through the vertical slot.

18. The kit for building a stairway of claim 1, further comprising a stringer adapted to be disposed on a wall where the step module is adjacent to the wall.

19. The kit for building a stairway of claim 1, further comprising a finishing board adapted to be disposed on a lateral side of the step module.

20. The kit for building a stairway of claim 1, wherein the vertical slot comprises an inside wall that is angled so as to provide room to receive a tip of an adhesive substance container.

21. The kit for building a stairway of claim 1, wherein the vertical slot comprises an inside wall that is angled, the angled inside wall and the fastener providing to receive an adhesive substance therebetween.

22. The kit for building a stairway of claim 1, wherein the rear edge of the tread of the adjacent step module comprises a cavity surrounding the fastener secured thereto for receiving an adhesive, the cavity providing a space for the adhesive to adhere to the tread of the adjacent step module, the fastener and the riser of the step module.

23. A method for building a stairway comprising:

providing a first step module, the first step module comprising a first riser and a first tread, the first riser being mounted on a first side thereof to at least near a front edge of the first tread comprising a vertical and elongated slot on a second side thereof, the first tread being secured atop the first riser on one side thereof;

providing an adjacent second step module, the adjacent second step module comprising a second riser and a second tread, the second riser mounted on a first side thereof to at least near a front edge of the second tread and the tread being secured atop the second riser on one side thereof and comprising a rear edge thereof adapted to receive a fastener; and assembling the adjacent second step module with the first step module by engaging the fastener with the vertical slot of the second step module and securing the fastener to the rear edge of the second tread of the adjacent second step module to secure the two step modules together, wherein the vertical slot comprises an inside wall that is angled opening along an upward slope away from the second tread of the adjacent second step module thereby defining a removable tip.

24. The method for building a stairway of claim 23, wherein the vertical slot is adapted to provide a riser height adjustment between the step modules.

25. The method for building a stairway of claim 24, wherein the riser height adjustment is about between 0 millimeter and 25 millimeters long.

26. The method for building a stairway of claim 23, wherein the slot is a plurality of slots and the fastener is a plurality of fasteners.

27. The method for building a stairway of claim 23, wherein at least one of the step modules further comprises a support member disposed on a hidden side of the step, between the tread and the riser, to further secure the tread with the riser.

28. The method for building a stairway of claim 23, wherein at least one of the step modules further comprises a substantially triangular junction element adapted to be disposed between the tread and the riser to further secure the step with the riser.

29. The method for building a stairway of claim 28, wherein the step modules each define defines lateral sides, the substantially triangular junction element being adapted to be disposed in a vicinity of a lateral side.

30. The method for building a stairway of claim 28, wherein an interface between the substantially triangular junction element and at least one of the tread and the riser is adapted to receive a securing material.

31. The method for building a stairway of claim 30, wherein the interface further defines a securing material receiving portion.

32. The method for building a stairway of claim 30, wherein the securing material is glue.

33. The method for building a stairway of claim 23, wherein the two step modules are adapted to be dry-assembled before being permanently secured.

34. The method for building a stairway of claim 23, wherein an interface between the two step modules is adapted to be further secured with a securing material.

35. The method for building a stairway of claim 34, wherein the securing material is glue.

36. The method for building a stairway of claim 34, wherein the interface further defines a securing material receiving portion.

37. The method for building a stairway of claim 36, wherein the securing material receiving portion at least partially surrounds the fastener mating portion.

38. The method for building a stairway of claim 36, wherein the securing material is adapted to be introduced through the vertical slot.

39. The method for building a stairway of claim 23, further comprising a stringer adapted to be disposed on a wall where the step module is adjacent to the wall.

40. The method for building a stairway of claim 23, further comprising a finishing board adapted to be disposed on a lateral side of the step module.

* * * * *